US011547173B2

(12) United States Patent
Mariacher

(10) Patent No.: US 11,547,173 B2
(45) Date of Patent: Jan. 10, 2023

(54) CLIMBING SHOE

(71) Applicant: CALZATURIFICIO S.C.A.R.P.A. S.p.A., Asolo (IT)

(72) Inventor: Heinrich Mariacher, Asolo (IT)

(73) Assignee: CALZATURIFICIO S.C.A.R.P.A. S.P.A, Asolo (IT)

( * ) Notice: Subject to any disclaimer, the term of this patent is extended or adjusted under 35 U.S.C. 154(b) by 280 days.

(21) Appl. No.: 16/697,798

(22) Filed: Nov. 27, 2019

(65) Prior Publication Data

US 2020/0170332 A1 Jun. 4, 2020

(30) Foreign Application Priority Data

Nov. 30, 2018 (IT) ..... 102018000010719

(51) Int. Cl.
*A43B 5/00* (2022.01)
*A43B 13/04* (2006.01)

(52) U.S. Cl.
CPC ..... *A43B 5/003* (2013.01); *A43B 13/04* (2013.01)

(58) Field of Classification Search
CPC ..... A43B 5/003
See application file for complete search history.

(56) References Cited

U.S. PATENT DOCUMENTS 4,506,460 A * 3/1985 Rudy ..... A43B 13/206 36/38
5,142,797 A * 9/1992 Cole, III ..... A43B 13/181 36/102
7,487,604 B2 * 2/2009 Perron, Jr. ..... A43B 5/02 36/108
7,543,399 B2 * 6/2009 Kilgore ..... A43B 13/36 36/15
7,895,772 B2 * 3/2011 Mariacher ..... A43B 3/0052 36/97
9,801,427 B2 * 10/2017 Mariacher ..... A43B 13/141
(Continued)

FOREIGN PATENT DOCUMENTS

EP 0933033 A2 8/1999
EP 1880622 A1 1/2008
(Continued)

OTHER PUBLICATIONS

Italian Search Report and Written Opinion issued by Ministero dello Sviluppo Economico for Italian Application No. IT201800010719, dated Sep. 23, 2019, pp. 1-7.

*Primary Examiner* — Jila M Mohandesi
(74) *Attorney, Agent, or Firm* — The Belles Group, P.C.

(57) ABSTRACT

A climbing shoe comprising: a shoe-upper which is shaped so as to accommodate and cover substantially the whole foot of the user; a sole made of polymeric material, which is fixed to the bottom of the shoe-upper so as to cover the front part of the bottom of said shoe-upper; a front tensioning band made of elastomeric material, which is substantially U-bent and is fixed to the toe of the shoe-upper so as to embrace/surround the front part of the bottom of the shoe-upper, while joining to the front sole; a rear patch made of soft and flexible material, which is arranged astride of the rear part of the shoe-upper, in the area above the heel portion of the shoe-upper; and a rear tensioning band which is substantially U-bent and is firmly fixed to the shoe-upper so that the central elbow/bend of the rear tensioning band covers the plantar arch portion of the bottom, and the two branches of the rear tensioning band extend obliquely along the two lateral sides of the shoe-upper up to reach and firmly join said rear patch.

17 Claims, 4 Drawing Sheets

(56) References Cited

U.S. PATENT DOCUMENTS

| | | | | |
|---|---|---|---|---|
| 2002/0152642 | A1* | 10/2002 | Chu | A43B 13/12 36/25 R |
| 2013/0104420 | A1* | 5/2013 | Heathcote | A43B 5/12 36/102 |

FOREIGN PATENT DOCUMENTS

| | | | |
|---|---|---|---|
| EP | 2949232 | A1 | 12/2015 |
| EP | 3387935 | A1 | 10/2018 |

* cited by examiner

CLIMBING SHOE

CROSS-REFERENCE TO RELATED APPLICATIONS

This Patent Application claims priority from Italian Patent Application No. 102018000010719 filed on Nov. 30, 2018, the entire disclosure of which is incorporated herein by reference.

TECHNICAL FIELD

The present invention relates to a climbing shoe.

BACKGROUND ART

As is known, the currently most popular climbing shoes comprise: a leather and/or fabric shoe-upper that is substantially sock-shaped so as to accommodate and cover the user's foot, including the sole of the foot; a front tensioning band that is made of a high-elasticity elastomeric material, is substantially U-bent, and is fixed to the toe of the shoe-upper by gluing so as to surround the tarsus-phalangeal portion of the user's foot; a rear tensioning band that is made of a high-elasticity elastomeric material, is substantially U-bent, and is fixed by gluing to the rear part of the shoe-upper so as to cover the area above the Calcaneus of the user's foot, and then to extend along the two lateral sides of the shoe-upper up to reach and join the front tensioning band; and a lower sole which is made of a soft and flexible polymeric material with a high friction coefficient and substantially inextensible, and is fixed by gluing to the bottom of the shoe upper, partially overlapping the front and rear tensioning bands, so as to cover the whole of the sole of the user's foot.

Patent EP2274994 additionally describes a climbing shoe provided with an additional tensioning band, again made of a high-elasticity elastomeric material, which is substantially V-shaped and is fixed by gluing to the lower part of the shoe-upper, beneath the sole, so as to cover the bottom of the shoe-upper in the metatarsophalangeal area of the sole of the foot, and then extend along the two lateral sides of the shoe-upper, up to reach and join the rear tensioning band.

Unfortunately, although working very well, the climbing shoe described above has a limited capability to adapt to the morphology of the user's foot with the comfort problems that this entails, and is excessively rigid with the operating limits that this entails.

The climbing shoe described above, in fact, is not very suitable for climbing rock walls that are grade IV or higher.

DISCLOSURE OF INVENTION

Aim of the present invention it to provided a climbing shoe which is lighter than those currently in use, and is moreover capable of binding the climber's foot better adapting itself to the morphology of the user's foot, so as to improve the foot-containment capacity of the footwear.

In compliance with these aims, according to the present invention there is provided a climbing shoe as defined in claim 1 and preferably, though not necessarily, in any one of the dependent claims.

BRIEF DESCRIPTION OF THE DRAWINGS

The present invention will now be described with reference to the accompanying drawings, which illustrate a non-limiting embodiment thereof, wherein:

FIG. 5 is a view of the rear part of a first construction variant of the climbing shoe illustrated in FIG. 1; whereas

BEST MODE FOR CARRYING OUT THE INVENTION

Figure 1:
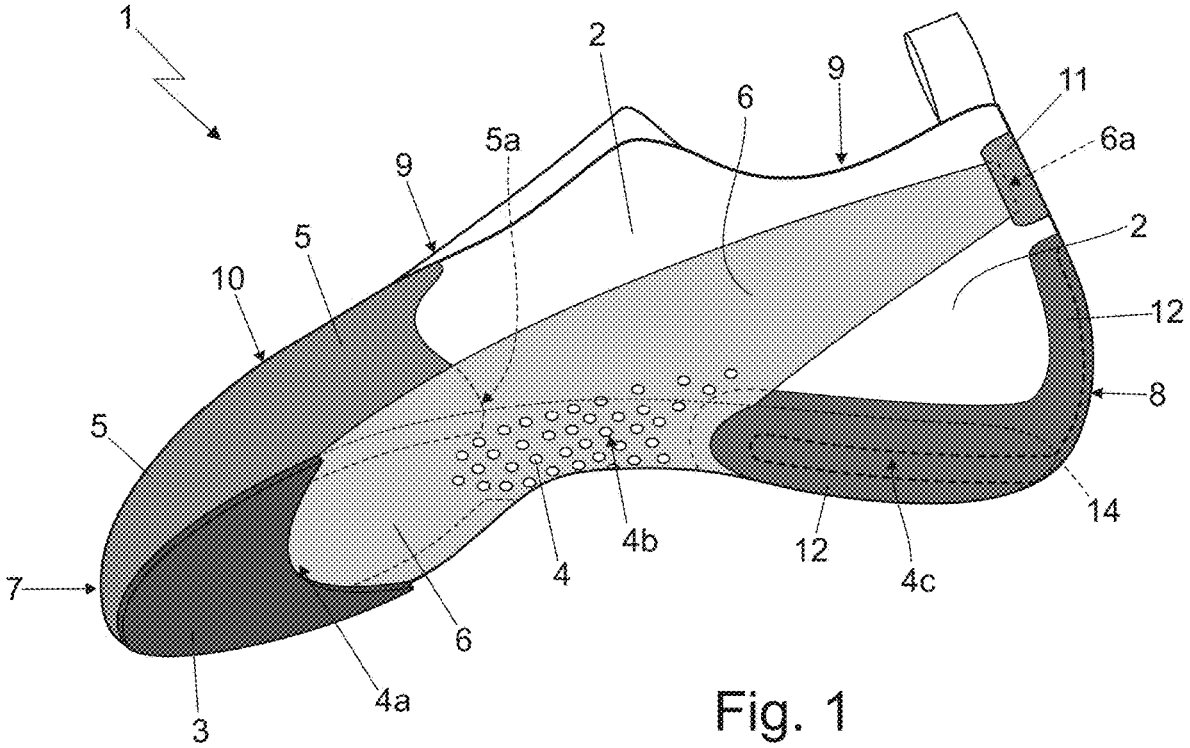
FIG. 1 is a perspective and schematic view of a climbing shoe realized according to the teachings of the present invention.

With reference to FIGS. 1, 2, 3, and 4, reference number 1 denotes as a whole a climbing shoe that may be particularly advantageously used for climbing on rock walls classified as grade IV or higher.

The climbing shoe 1 basically comprises: a shoe upper preferably made of leather and/or fabric, which is substantially sock-shaped so as to accommodate and completely cover the user's foot, including the sole of the foot; and a front sole 3 that is made of a soft and flexible polymeric material with a high friction coefficient and substantially inextensible, and is firmly fixed to the bottom 4 of the shoe-upper 2 preferably by gluing, so as to cover the front part of the bottom 4 of shoe upper 2.

In more detail, the bottom 4 of shoe-upper 2, i.e. the part/sector of shoe-upper 2 that covers the sole of the user's foot, is longitudinally divided into a front or tarsus-phalangeal portion 4*a* that is immediately underneath the tarsus-phalangeal region of the sole of the user's foot; a central or plantar-arch portion 4*b* that is immediately underneath the plantar-arch region; and a rear or talus-calcaneal portion 4*c* that is immediately underneath the talus-calcaneal region of the sole of the user's foot.

The front sole 3 is preferably shaped/dimensioned so as to substantially cover solely the front or tarsus-phalangeal portion 4*a* of the bottom 4 of shoe-upper 2.

Preferably, the front sole 3 is moreover made of a polymeric material having a hardness (UNI 4916) preferably lower than 80 Shore A and optionally ranging between 50 and 75 Shore A.

In more detail, in the example shown, the front sole 3 is preferably made of a soft and flexible polymeric material such as, for example, the XS Edge compound or the GRIP 2 compound manufactured by the Italian firm VIBRAM S.P.A.

The climbing shoe 1 additionally comprises a plurality of tensioning bands that are made of a high-elasticity elastomeric material, are preferably pre-tensioned, and are finally firmly fixed to the shoe-upper 2 preferably by gluing, so as to embrace and tighten the shoe upper 2 against the user's foot.

In more detail, each tensioning band has a monolithic structure, and is preferably made of an elastomeric material having an elastic modulus (also known as Young's modulus) significantly lower than that of the polymeric material forming the front sole 3.

In other words, the tensioning bands are preferably made of elastomeric materials having an elastic modulus 2-10 times lower than that of the polymeric material forming the sole 3, and preferably also a hardness (UNI 4916) greater than that of the polymeric material forming the sole 3.

Preferably the tensioning band or bands are moreover pre-tensioned so as to tighten the shoe-upper 2 on the user's foot, to the limit of physical pain.

With reference to FIGS. 1, 2, 3 and 4, in particular, the climbing shoe 1 is preferably provided with a front tensioning band 5 and with a rear tensioning band 6, both with a monolithic structure and preferably pre-tensioned.

The front tensioning band 5 is substantially U-bent and is firmly fixed to the toe 7 of the shoe-upper 2 preferably by gluing, so as to surround/embrace the front part of the bottom 4 of shoe-upper 2, firmly joining at same time the front sole 3 preferably by gluing.

In more detail, the front tensioning band 5 is firmly fixed to the toe 7 of shoe-upper 2 so as to cover the area of shoe upper 2 that surrounds/flanks the tarsus-phalangeal portion 4*a* of the bottom 4, preferably also extending on the bottom 4 of shoe-upper 2, underneath the sole 3.

In other words, the lower edge of the front tensioning band 5 extends on the bottom 4 of shoe-upper 2 so as to be at least partially overlapped by the sole 3, and is firmly fixed to the sole 3 preferably by gluing.

Preferably, the front tensioning band 5 moreover extends along the two inner and outer lateral sides of shoe-upper 2, towards the heel portion 8 of shoe-upper 2 (i.e. towards the portion of shoe-upper 2 that covers and protects the Calcaneus of the user's foot), so that the two ends 5*a* of the band 5 reach and, optionally, also go beyond the boundary line between the tarsus-phalangeal portion 4*a* and the plantar arch portion 4*b* of the bottom 4, preferably remaining spaced one from the other.

Figure 2:
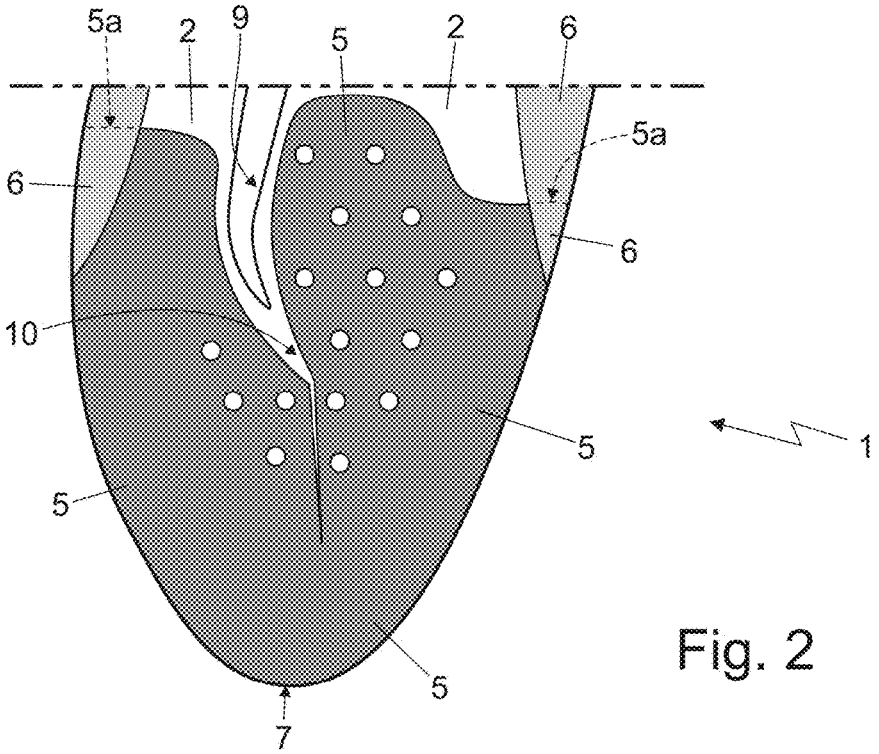
FIG. 2 is a view of the upper-front part of the climbing shoe illustrated in FIG. 1.

Moreover, with particular reference to FIG. 2, the central part of front tensioning band 5 is preferably also shaped so as to extend along the upper part of shoe-upper 2 towards the in step of user's foot, preferably substantially up to meet and, optionally, surround/embrace the front end of the upper fitting opening 9 of shoe-upper 2, so as to substantially cover the upper-front part 10 of shoe-upper 2 without any interruptions.

The front part of the user's foot is thus protected, on the bottom, by the sole 3 and, on top, by the central part of front tensioning band 5.

Preferably, the front tensioning band 5 is finally made of an elastomeric material with a hardness (UNI 4916) greater than or equal to 80 Shore A.

With reference to FIGS. 1, 2, 3 and 4, the climbing shoe 1 additionally comprises a small rear patch 11 made of soft and flexible material, which is arranged astride the rear part of shoe-upper 2 in the area immediately adjacent and above the heel portion 8 of shoe-upper 2; and the rear tensioning band 6 is substantially U-bent and is firmly fixed to the shoe-upper 2 preferably by gluing, so that the central elbow/bend of the band covers the plantar arch portion 4*b* of bottom 4, preferably locally also overlapping the lower edge of front tensioning band 5, while the two branches of the rear tensioning band 6 extend obliquely along the two inner and outer lateral sides of shoe-upper 2 up to reach and firmly join the rear patch 11.

Clearly, the two ends 6*a* of rear tensioning band 6 reach the rear patch 11 from opposite sides of the latter and remain spaced/distanced from each other.

More specifically, the two ends 6*a* of rear tensioning band 6 are preferably overlapped by the rear patch 11, and are firmly fixed to the rear patch 11 preferably by gluing.

At the overlap points, moreover, the rear tensioning band 6 surmounts and is firmly fixed to the front tensioning band 5 preferably by gluing.

In addition, the central elbow of rear tensioning band 6 is preferably dimensioned so as to also extend within the tarsus-phalangeal portion 4*a* of the bottom 4 of shoe-upper 2, underneath the front sole 3.

The rear patch 11, on the other hand, is preferably made of a soft and flexible polymeric material that is optionally also substantially inextensible, and is preferably firmly fixed to the rear part of shoe-upper 2 preferably by gluing.

In addition, the rear patch 11 is preferably arranged astride of the midplane M of the shoe, immediately above the heel portion 8 of shoe-upper 2, so as to extend substantially astride the point where the Achilles tendon attaches to the Calcaneus of the user's foot.

The two ends 6*a* of rear tensioning band 6, therefore, are preferably located on opposite sides of the shoe midplane M.

Preferably, the polymeric material forming the rear patch 11 is moreover less hard than the elastomeric material forming the rear tensioning band 6.

In the example shown, in particular, likewise the front tensioning band 5, the rear tensioning band 6 is preferably made of an elastomeric material having a hardness (UNI 4916) greater than or equal to 80 Shore A.

The rear patch 11, in turn, is preferably made of a soft and flexible polymeric material having a hardness (UNI 4916) lower than 80 Shore A and optionally ranging between 50 and 75 Shore A.

Figure 3:
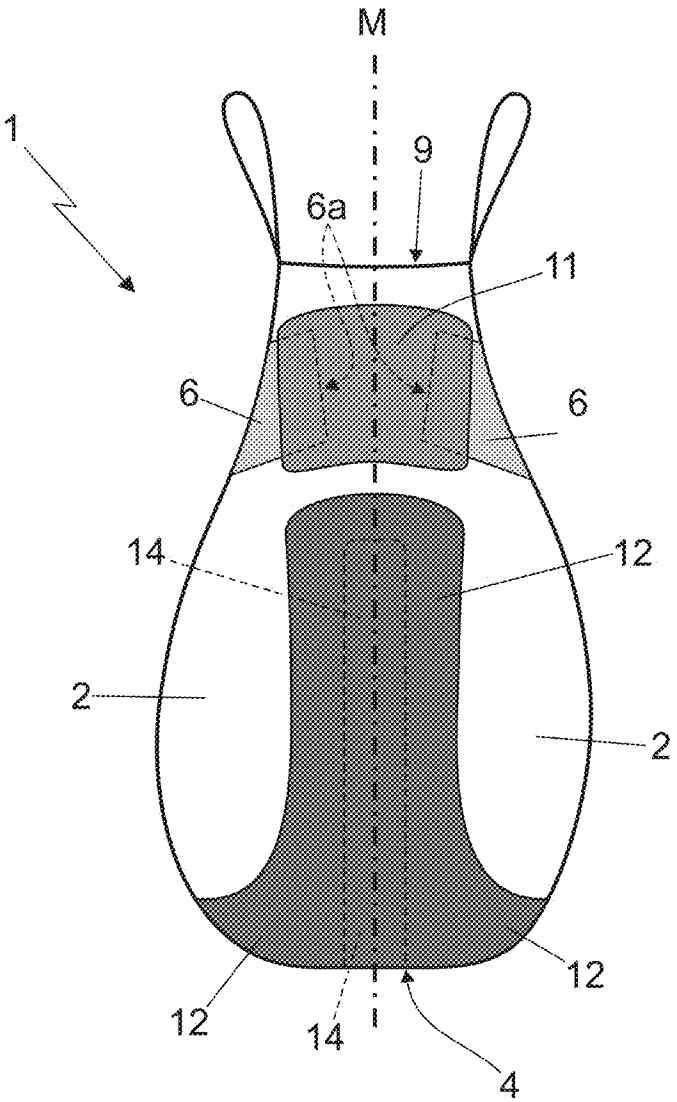
FIG. 3 is a view of the rear part of the climbing shoe illustrated in FIG. 1.
Figure 4:
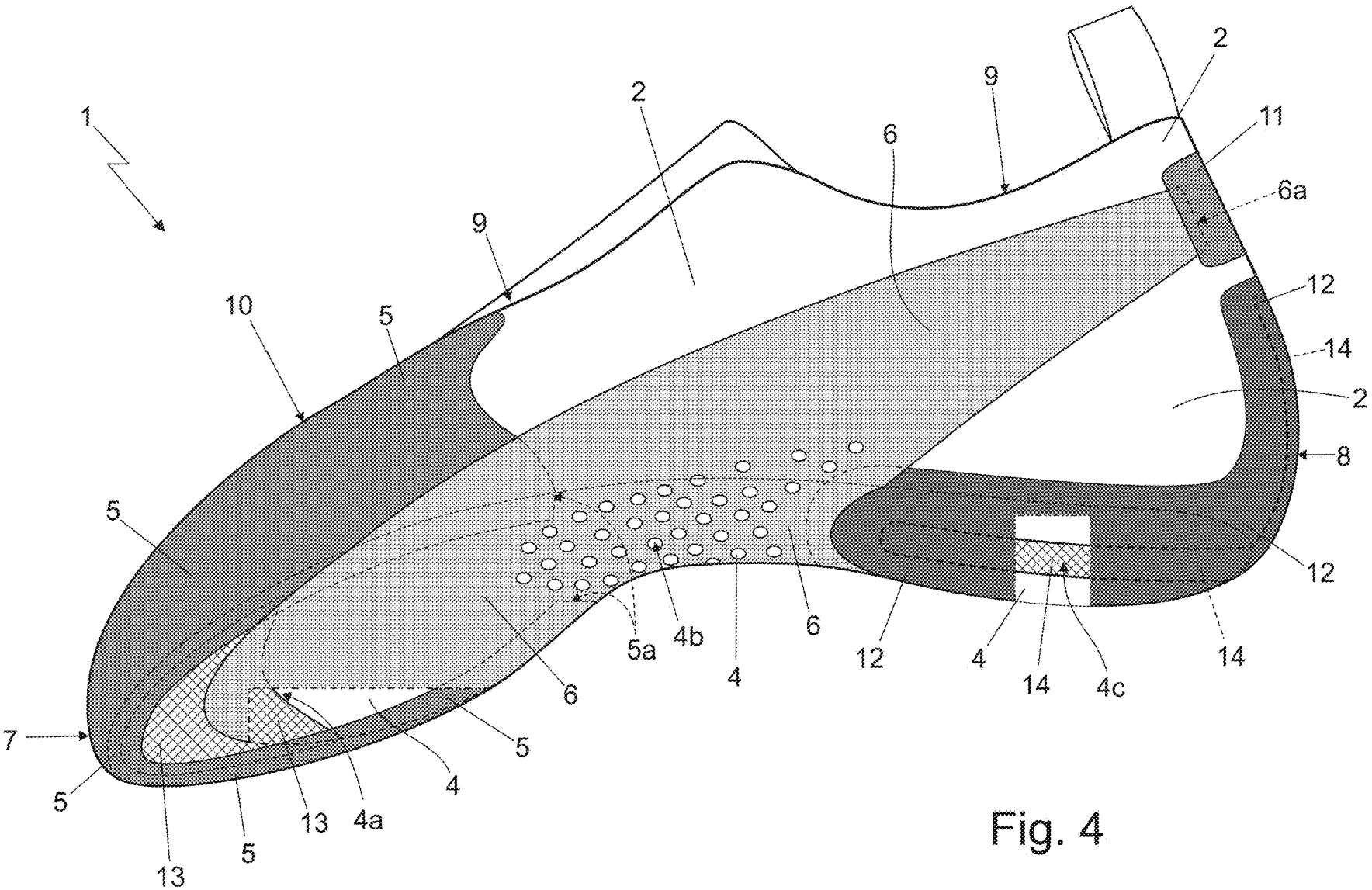
FIG. 4 is a perspective and partially sectioned view of the climbing shoe illustrated in FIG. 1, with parts removed for the sake of clarity.

With reference to FIGS. 1, 3, and 4, in addition the climbing shoe 1 preferably also comprises a rear protective sheet 12 which is made of a soft and flexible, and optionally substantially inextensible, polymeric material, and is firmly fixed to the shoe-upper 2 preferably by gluing, so as to cover the rear part of the bottom 4 of shoe upper 2 while remaining spaced from the front sole 3.

In addition, the rear protective sheet 12 is preferably also shaped so as to rise up along the rear part of shoe-upper 2, towards the rear patch 11, while remaining substantially astride the shoe midplane M, so as to also cover the heel portion 8 of shoe-upper 2.

In other words, the rear protective sheet 12 is preferably oblong in shape and is firmly fixed to the shoe-upper 2 so as to cover the rear part of bottom 4 and the heel portion 8.

Preferably, the polymeric material forming the rear protective sheet 12 moreover has a hardness lower than that of the elastomeric material forming the rear tensioning band 6, and optionally also a hardness greater than that of the polymeric material forming the front sole 3.

In more detail, the rear protective sheet 12 is preferably dimensioned so as to cover the talus-calcaneal portion 4*c* of the bottom 4 of shoe-upper 2, optionally also extending over the plantar-arch portion 4*b* of the bottom 4 preferably while remaining underneath the rear tensioning band 6.

Preferably the protective sheet 12 is furthermore substantially L-bent and is shaped/dimensioned so as to also cover the heel portion 8 of shoe-upper 2, while remaining spaced from the rear patch 11.

In other words, the rear protective sheet 12 is preferably oblong in shape, and is preferably substantially L-bent so as to cover the talus-calcaneal portion 4*c* of the bottom 4 and the heel portion 8 of shoe upper 2, while remaining substantially astride of the shoe midplane M.

In the example shown, in particular, the rear protective sheet 12 is preferably made of a polymeric material having a hardness (UNI 4916) preferably lower than 75 Shore A and optionally ranging between 50 and 65 Shore A.

With reference to FIGS. 1, 3 and 4, finally the climbing shoe 1 is preferably provided with a semi-rigid front insert 13 and/or with a semi-rigid rear insert 14, both preferably made of semi-rigid polymeric material.

The semi-rigid front insert 13 has a plate-like structure that preferably underapproximates the shape of the front sole 3 and is firmly fixed to the bottom 4 of shoe-upper 2, or rather to the tarsus-phalangeal portion 4*a* of the bottom 4 of shoe-upper 2, underneath the front sole 3 and preferably also underneath the front tensioning band 5 and/or the rear tensioning band 6, so as to stiffen the front part of the climbing shoe 1.

In more detail, the semi-rigid front insert 13 is preferably made of nylon or thermoplastic polyurethane (TPU), and is preferably firmly fixed to the front sole 3 and to the bottom 4 of shoe-upper 2 by gluing.

The semi-rigid rear insert 14, on the other hand, has a ribbon-like structure, is substantially L-bent, and is firmly fixed to the rear part of the bottom 4, or rather on the talus-calcaneal portion 4*c* of the bottom 4, and to the heel portion 8 of shoe-upper 2, beneath the rear protective sheet 12 and substantially astride the midplane M, so as to stiffen the rear part of the climbing shoe 1.

Similarly to the semi-rigid front insert 13, also the semi-rigid rear insert 14 is preferably made of nylon or thermoplastic polyurethane (TPU), and is preferably firmly fixed to the shoe-upper 2 and to the rear protective sheet 12 by gluing.

The functioning of the climbing shoe 1 is easily inferable from the above description, and does not require further explanation.

The advantages connected to the particular shape and arrangement of the rear tensioning band 6 are remarkable.

First of all, the thus-made rear tensioning band 6 enables the elastic force to be distributed, in the rear part of the shoe, over a wider surface that, in addition, excludes the part of the foot where the Achilles tendon attaches to the Calcaneus, thus noticeably improving the comfort of the fit.

In more detail, the rear tensioning band 6, being interrupted in the area of the foot where the Achilles tendon attaches to the Calcaneus, enables the small rear patch 11 located there to distribute the pressure over a wider area of the foot, with a considerable increase in the shoe's comfort. All this, of course, without compromising in any way the foot-containment capacity of the shoe 1.

In addition, the special shape of the rear tensioning band 6 enables differentiated pre-tensioning of the inner and outer sides of the shoe, making it possible for the climbing shoe 1 to better adapt to the morphology of the user's foot.

Lastly, the climbing shoe 1 is considerably lighter than climbing shoes currently on the market, with all the advantages that this entails.

It is finally clear that modifications and variations may be made to the climbing shoe 1 without thereby departing from the scope of the present invention.

For example, the semi-rigid front insert 13 and/or semi-rigid rear insert 14 may be made of a polymeric material loaded with carbon nanoparticles. Preferably the carbon nanoparticles are moreover graphene particles and/or carbon nanotubes.

Figure 5:
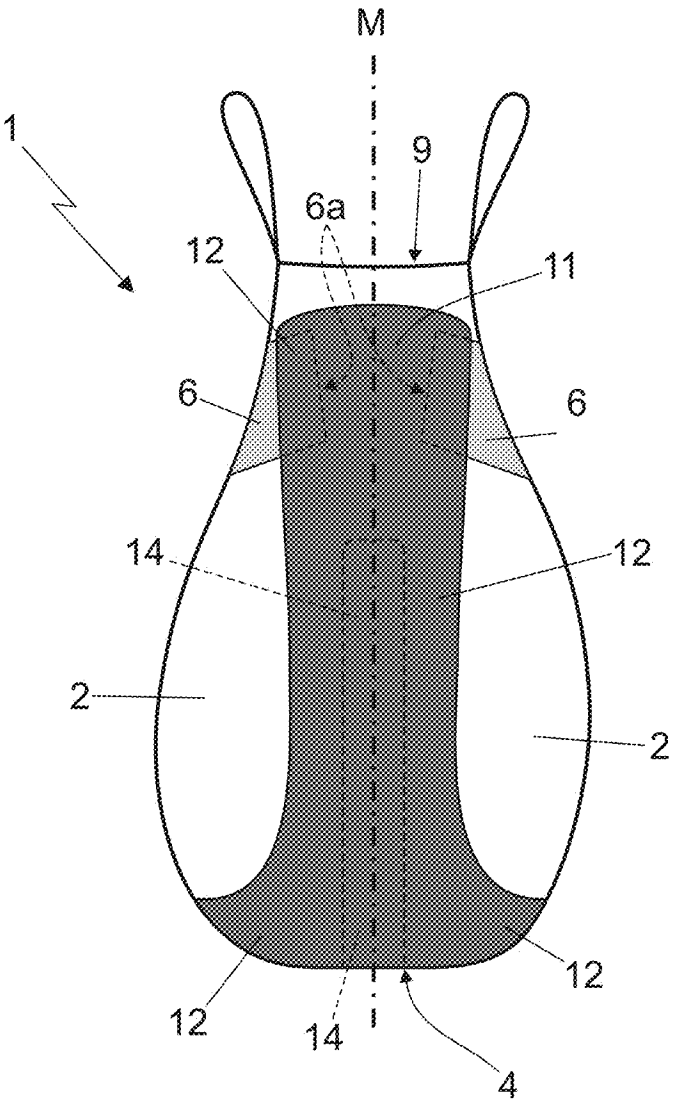

In addition, with reference to FIG. 5, in a different embodiment the rear patch 11 can be made in one piece with the protective sheet 12.

In other words, the rear patch 11 can be an extension of the rear protective sheet 12.

Figure 6:
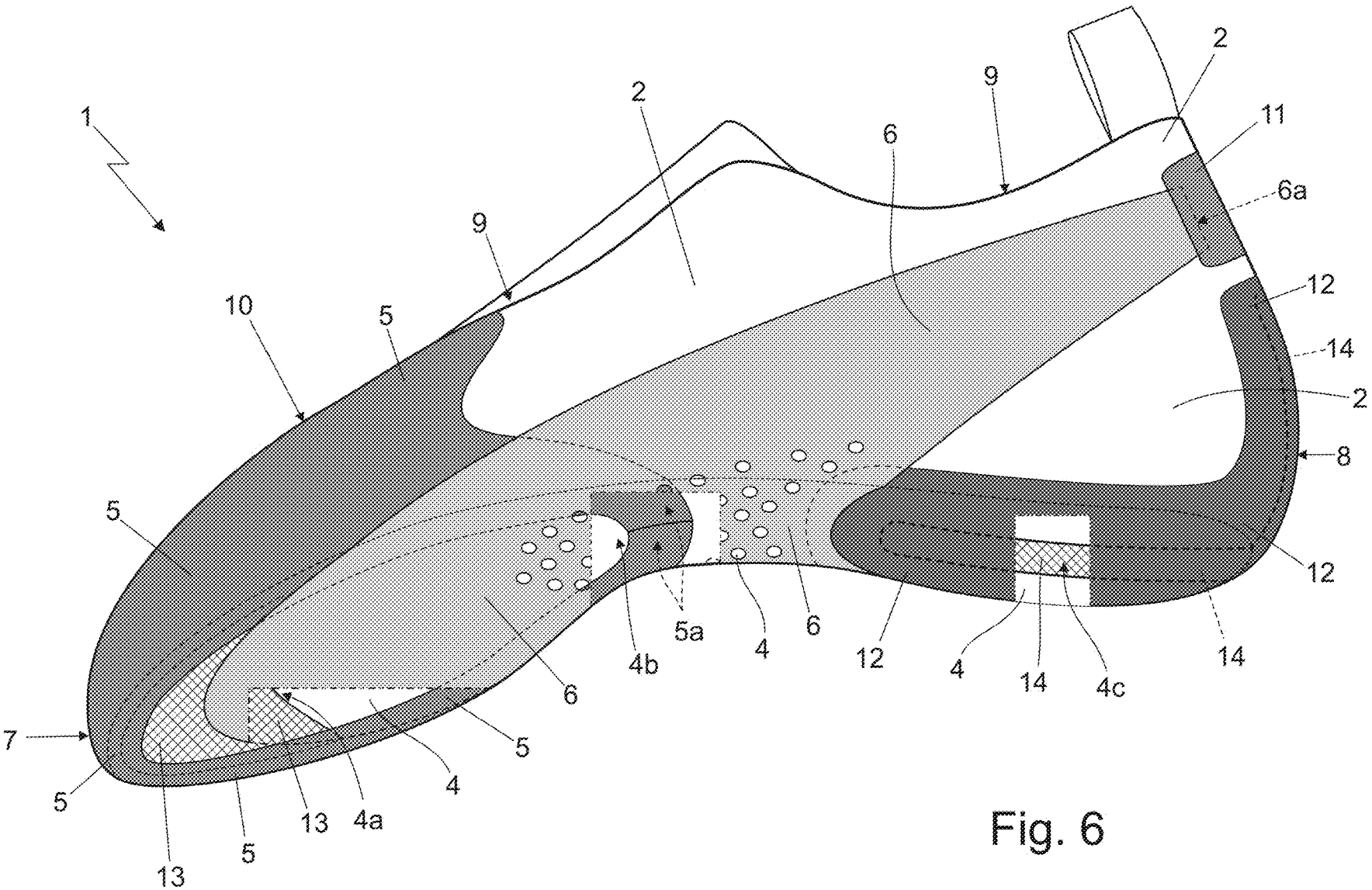
FIG. 6 is a perspective and partially sectioned view of a second construction variant of the climbing shoe illustrated in FIG. 1.

Finally, with reference to FIG. 6, in a more sophisticated embodiment, the two ends 5*a* of front tensioning band 5 extend/prolong on the bottom 4 of shoe-upper 2, one towards the other, so as to firmly reach/join to one another preferably at the plantar arch portion 4*b* of the bottom 4, obviously underneath the rear tensioning band 6.

The front tensioning band 5 is, thus, designed to form a preferably pre-tensioned, elastic ring that surrounds and tightens the tarsus-phalangeal portion 4*a* of the bottom 4 of shoe-upper 2.

In more detail, in the example shown, the two ends 5*a* of the front tensioning band 5 are preferably overlapped and glued one on the other.

Preferably, the two ends 5*a* of the front tensioning band 5, in addition, connect to each other near the border between the tarsus-phalangeal portion 4*a* and the plantar arch portion 4*b* of the bottom 4.

The invention claimed is:

1. A climbing shoe comprising: a shoe-upper which is shaped so as to accommodate and cover substantially the whole foot of the user; a sole made of polymeric material and which is fixed to the bottom of the shoe-upper so as to cover the front part of the bottom of said shoe-upper; and a front tensioning band made of elastomeric material and which is substantially U-bent and fixed to a toe of the shoe-upper so as to surround the front part of the bottom of the shoe-upper, while joining to the front sole;

the climbing shoe further comprising: a rear patch made of soft and flexible material and which is arranged astride of the rear part of the shoe-upper, in the area above a heel portion of the shoe-upper; and a rear tensioning band distinct from the rear patch, which is made of elastomeric material, has a monolithic structure and is substantially U-bent and is firmly fixed to the shoe-upper so that a central bend of the rear tensioning band covers the plantar arch portion of the bottom, and two separated branches of the rear tensioning band extend obliquely along two lateral sides of the shoe-upper up to reach and become firmly joined via the rear patch while remaining separated from one another prior to being joined via the rear patch.

2. The climbing shoe according to claim 1, wherein the rear patch is made of a soft and flexible polymeric material.

3. The climbing shoe according to claim 1, wherein the rear patch is firmly fixed to the shoe-upper by gluing.

4. The climbing shoe according to claim 1, wherein the polymeric material forming the rear patch has a hardness lower than that of the elastomeric material forming the rear tensioning band.

5. The climbing shoe according to claim 1, wherein the rear tensioning band overlaps and is firmly fixed to the front tensioning band.

6. The climbing shoe according to claim 1, further comprising a rear protective sheet which is made of a soft and flexible polymeric material and is firmly fixed to the bottom of the shoe-upper so as to cover the rear part of the bottom of the shoe-upper while remaining spaced from the sole.

7. The climbing shoe according to claim 6, wherein the rear protective sheet is oblong in shape and is firmly fixed also to the rear part of the shoe-upper so as to additionally cover the heel portion of the shoe-upper.

8. The climbing shoe according to claim 6, wherein the polymeric material forming the rear protective sheet has a hardness lower than that of the elastomeric material forming the rear tensioning band.

9. The climbing shoe according to claim 7, wherein the rear patch is spaced from the rear protective sheet.

10. The climbing shoe according to claim 7, wherein the rear patch is made in one piece with the rear protective sheet.

11. The climbing shoe according to claim 1, wherein the sole is at least one of: shaped, or dimensioned, so as to substantially cover only the tarsus-phalangeal portion of the bottom of the shoe-upper.

12. The climbing shoe according to claim 1, wherein the two ends of the front tensioning band on the bottom of the shoe-upper one towards the other, so as to join firmly to one another substantially at the plantar arch portion of said bottom.

13. The climbing shoe according to claim 1, further comprising a semi-rigid front insert which has a plate-like structure and is firmly fixed to the bottom of the shoe-upper, underneath the sole.

14. The climbing shoe according to claim 7, further comprising a semi-rigid rear insert which has a ribbon-like structure, is substantially L-bent, and is firmly fixed to the bottom and to the heel portion of the shoe-upper, underneath the rear protective sheet.

15. The climbing shoe according to claim 13, wherein the semi-rigid front insert is made of semi-rigid polymeric material.

16. The climbing shoe according to claim 1, wherein the rear patch is substantially inextensible.

17. The climbing shoe according to claim 14, wherein the semi-rigid rear insert is made of semi-rigid polymeric material.

* * * * *